US009631304B2

(12) United States Patent
Friman et al.

(10) Patent No.: US 9,631,304 B2
(45) Date of Patent: Apr. 25, 2017

(54) VARIABLE TIMING SYSTEM OF A SEWING MACHINE AND METHOD FOR SELECTIVELY ADJUSTING A TIMING OF SUCH A SYSTEM

(71) Applicant: Singer Sourcing Limited LLC, Lavergne, TN (US)

(72) Inventors: Bertil Friman, Tenhult (SE); Rolf Wahlström, Jönköping (SE); Kent Askenmalm, Huskvarna (SE); Stefan Stark, Huskvarna (SE)

(73) Assignee: Singer Sourcing Limited LLC, Lavergne, TN (US)

( * ) Notice: Subject to any disclaimer, the term of this patent is extended or adjusted under 35 U.S.C. 154(b) by 433 days.

(21) Appl. No.: 14/206,806

(22) Filed: Mar. 12, 2014

(65) Prior Publication Data

US 2014/0261123 A1 Sep. 18, 2014

Related U.S. Application Data

(60) Provisional application No. 61/788,694, filed on Mar. 15, 2013.

(51) Int. Cl.

| | |
|---|---|
| ***D05B 1/00*** | (2006.01) |
| ***D05B 19/12*** | (2006.01) |
| ***D05B 57/30*** | (2006.01) |
| ***D05B 73/12*** | (2006.01) |

(52) U.S. Cl.
CPC ..... *D05B 19/12* (2013.01); *D05B 57/30* (2013.01); *D05B 73/12* (2013.01)

(58) Field of Classification Search
CPC ..... D05B 73/12; D05B 11/00; D05B 57/00; D05B 57/14; D05C 11/18
USPC ..... 112/475.01, 95, 164, 185, 232
See application file for complete search history.

(56) References Cited

U.S. PATENT DOCUMENTS

| | | | |
|---|---|---|---|
| 286,662 | A | 10/1883 | Wendell |
| 590,726 | A | 9/1897 | Merrick |
| 2,717,567 | A | 9/1955 | Hess |
| 2,836,137 | A | 5/1958 | Ayres |
| 3,550,544 | A | 12/1970 | Fairfield et al. |

(Continued)

FOREIGN PATENT DOCUMENTS

| | | | |
|---|---|---|---|
| DE | 102007001073 | A1 | 8/2007 |
| EP | 39680 | A1 | 11/1981 |

(Continued)

*Primary Examiner* — Tejash Patel
(74) *Attorney, Agent, or Firm* — Calfee, Halter & Griswold LLP

(57) ABSTRACT

A variable timing system for a sewing machine is provided comprising a shuttle hook having a hook tip, a first helical gear mounted on the shuttle hook, a lower shaft configured to rotate the shuttle hook in synchronization with a needle bar, and a second helical gear mounted on the lower shaft and capable of engaging with the first helical gear. In accordance with embodiments, at least one of the helical gears is axially movable. The variable timing system may comprise a control device configured to generate a control signal representative of a current sewing situation. A drive force mechanism may receive the control signal and in response, transmit axial movement to the axially moveable helical gear to move the gear into proper position relative to a threaded needle of the sewing machine.

26 Claims, 9 Drawing Sheets

(56) References Cited

U.S. PATENT DOCUMENTS

| | | | | |
|---|---|---|---|---|
| 3,570,426 | A | 3/1971 | Kunes | |
| 3,585,950 | A | 6/1971 | Ito | |
| 3,589,320 | A | 6/1971 | Beazley | |
| 3,592,153 | A | 7/1971 | Margereson | |
| 3,613,608 | A | 10/1971 | Hinerfeld et al. | |
| 3,613,610 | A | 10/1971 | Hinerfeld et al. | |
| 3,664,288 | A | 5/1972 | Weidlin Von Boden et al. | |
| 3,698,334 | A | 10/1972 | Kleinschmidt et al. | |
| 3,721,204 | A | 3/1973 | Schaffer et al. | |
| 3,727,567 | A | 4/1973 | Beazley | |
| 3,763,805 | A | 10/1973 | Weigert | |
| 3,799,087 | A | 3/1974 | Beamish et al. | |
| 3,815,532 | A | 6/1974 | Weisz et al. | |
| 3,818,849 | A | 6/1974 | Maddox, Jr. | |
| 3,904,890 | A | 9/1975 | Wenrich et al. | |
| 3,967,566 | A | 7/1976 | Spiegel et al. | |
| 4,056,071 | A | 11/1977 | Adams | |
| 4,098,208 | A | 7/1978 | Hedegaard | |
| 4,116,145 | A | 9/1978 | Nicolay | |
| 4,185,575 | A | 1/1980 | Brown et al. | |
| 4,214,540 | A | 7/1980 | Cook | |
| 4,246,858 | A | 1/1981 | Ogawa | |
| 4,323,024 | A | 4/1982 | Jones et al. | |
| 4,324,191 | A | 4/1982 | Brown | |
| 4,342,272 | A | 8/1982 | Transue et al. | |
| 4,373,458 | A | 2/1983 | Dorosz et al. | |
| 4,409,914 | A | 10/1983 | Sansone | |
| 4,412,498 | A | 11/1983 | Scholl | |
| 4,414,909 | A | 11/1983 | Bray | |
| 4,425,859 | A * | 1/1984 | Ishitani | D05B 3/02 112/443 |
| 4,426,947 | A | 1/1984 | Marshall | |
| 4,467,739 | A | 8/1984 | Hager et al. | |
| 4,479,448 | A | 10/1984 | Jones et al. | |
| 4,502,400 | A | 3/1985 | Walther | |
| 4,503,794 | A | 3/1985 | Ishihara et al. | |
| 4,519,331 | A | 5/1985 | Kosrow et al. | |
| 4,569,297 | A | 2/1986 | Dusch | |
| 4,648,337 | A | 3/1987 | Mall | |
| 4,660,485 | A * | 4/1987 | Morgan | D05B 57/14 112/227 |
| 4,677,926 | A | 7/1987 | Dusch et al. | |
| 4,686,917 | A | 8/1987 | Braun | |
| 4,706,587 | A | 11/1987 | Shiomi | |
| 4,726,309 | A | 2/1988 | Popp | |
| 4,803,937 | A | 2/1989 | Hiramatsu et al. | |
| 4,867,082 | A | 9/1989 | Sabbioni et al. | |
| 5,138,962 | A | 8/1992 | Klundt | |
| 5,461,997 | A | 10/1995 | Landen | |
| 5,481,995 | A | 1/1996 | Hiratsuka et al. | |
| 6,189,989 | B1 | 2/2001 | Hirabayashi et al. | |
| 6,394,012 | B1 | 5/2002 | French et al. | |
| 6,736,077 | B2 | 5/2004 | Pokrishevsky et al. | |
| 7,240,628 | B2 | 7/2007 | Friman et al. | |
| 7,255,052 | B2 | 8/2007 | Okazaki | |
| 7,506,596 | B2 | 3/2009 | Bowlus | |
| 7,918,169 | B2 | 4/2011 | Mack et al. | |
| 7,958,833 | B2 | 6/2011 | Fujihara | |
| 7,966,957 | B2 | 6/2011 | Mack et al. | |
| 8,245,654 | B2 | 8/2012 | Konig et al. | |
| 8,297,121 | B2 * | 10/2012 | Quer | G01P 1/006 73/514.29 |
| 8,387,547 | B2 | 3/2013 | Bardh et al. | |
| 2003/0140830 | A1 | 7/2003 | Pokrishevsky et al. | |
| 2007/0245940 | A1 | 10/2007 | Wahlstrom | |
| 2007/0272135 | A1 | 11/2007 | Fujihara | |
| 2009/0114133 | A1 | 5/2009 | Fujihara | |
| 2011/0094426 | A1 | 4/2011 | Eklund et al. | |
| 2011/0113999 | A1 | 5/2011 | Widell et al. | |
| 2011/0146551 | A1 | 6/2011 | Bardh | |
| 2011/0290168 | A1 | 12/2011 | Kawai | |
| 2012/0017815 | A1 | 1/2012 | Fujihara | |

FOREIGN PATENT DOCUMENTS

| | | | |
|---|---|---|---|
| EP | 1777331 | A1 | 4/2007 |
| GB | 190905542 | A | 7/1909 |
| GB | 191124452 | A | 8/1912 |
| GB | 1179964 | A | 2/1970 |
| GB | 1179965 | A | 2/1970 |
| GB | 1182563 | A | 2/1970 |
| GB | 1200024 | A | 7/1970 |
| GB | 1282153 | A | 7/1972 |
| GB | 1310091 | A | 3/1973 |
| GB | 1315001 | A | 4/1973 |
| GB | 1320765 | A | 6/1973 |
| GB | 1375540 | A | 11/1974 |
| GB | 1393294 | A | 5/1975 |
| GB | 1440350 | A | 6/1976 |
| GB | 2028388 | A | 3/1980 |
| GB | 2043124 | A | 10/1980 |
| GB | 1583629 | A | 1/1981 |
| JP | 6304359 | A | 7/2007 |
| WO | 8101020 | A1 | 4/1981 |
| WO | 8203879 | A1 | 11/1982 |
| WO | 8901067 | A1 | 2/1989 |

* cited by examiner

PRIOR ART

PRIOR ART

VARIABLE TIMING SYSTEM OF A SEWING MACHINE AND METHOD FOR SELECTIVELY ADJUSTING A TIMING OF SUCH A SYSTEM

CROSS-REFERENCE TO RELATED APPLICATIONS

This patent application claims priority to U.S. Provisional Patent Application Ser. No. 61/788,694 titled "VARIABLE TIMING SYSTEMS" filed on Mar. 15, 2013 which is hereby incorporated herein by reference in its entirety for all purposes.

TECHNICAL FIELD

The present disclosure relates to sewing machines, and more specifically, to variable timing systems of sewing machines.

SUMMARY

In accordance with aspects and embodiments, a variable timing system of a sewing machine is provided comprising a shuttle hook having a hook tip, a first helical gear mounted on the shuttle hook, a lower shaft configured to rotate the shuttle hook in synchronization with vertical movement of a needle bar of the sewing machine, a second helical gear mounted on the lower shaft and capable of mesh engagement with the first helical gear, at least one of the first helical gear and the second helical gear being an axially moveable helical gear which is selectively moveable in its axial direction, a control device configured to process data representative of a current sewing situation of the sewing machine and to selectively generate a control signal in response to the processed data, and a drive force mechanism configured to receive the control signal and to transmit axial movement to the axially moveable helical gear in response to the control signal so as to axially move the axially moveable helical gear to one of a plurality of selectable positions provided in a range extending from a first end position to a second end position.

In accordance with aspects and embodiments, a sewing machine having a variable timing system in accordance with the above system is provided.

In accordance with aspects and embodiments, a method for selectively adjusting a timing of a variable timing system of a sewing machine is provided wherein the variable timing system comprises a shuttle hook having a hook tip, a first helical gear mounted on the shuttle hook, a lower shaft configured to rotate the shuttle hook in synchronization with vertical movement of a needle bar of the sewing machine and a second helical gear mounted on the lower shaft and capable of mesh engagement with the first helical gear, at least one of the first helical gear and the second helical gear being an axially moveable helical gear which is selectively moveable in its axial direction, the method comprising processing, by means of a control device, data representative of a current sewing situation of the sewing machine, selectively generating a control signal in response to the processed data, and transmitting axial movement to the axially moveable helical gear in response to the control signal to axially move the axially moveable helical gear to one of a plurality of selectable positions provided in a range extending from a first end position to a second end position.

In accordance with aspects and embodiments, a variable timing system for a sewing machine is provided comprising a rotatable shuttle having a hook tip, a first helical gear coupled to the rotatable shuttle, a second helical gear in communication with the first helical gear, and a lower shaft in communication with the second helical gear.

In accordance with aspects and embodiments, a variable timing system for a sewing machine is provided comprising a rotatable shuttle having a hook tip, a first helical gear coupled to the rotatable shuttle, a second helical gear in communication with the first helical gear, and a drive force mechanism in communication with the second helical gear.

In accordance with aspects and embodiments, a variable timing system for a sewing machine is provided comprising a rotatable shuttle having a hook tip, a first helical gear coupled to the rotatable shuttle, a second helical gear in communication with the first helical gear, and a drive force mechanism in communication with the first helical gear.

In accordance with aspects and embodiments, a sewing machine having a variable timing system in accordance with the variable timing systems disclosed above is provided.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. Where technical features in the figures, detailed description, or any claim, are followed by reference signs, the reference signs have been included for the sole purpose of increasing the intelligibility of the figures and description. In the figures, each identical or nearly identical component that is illustrated in various figures is represented by a like numeral. For purposes of clarity, not every component may be labeled in every figure.

DETAILED DESCRIPTION

Sewing machines generally use at least two threads to create stitches in a workpiece. The workpiece may be a piece of fabric which is placed on a needle plate under a needle attached to a needle bar. The eye of the needle is thread with a top thread. The threaded needle passes through the workpiece and through the needle plate, such that at least the eye of the needle passes through the workpiece. When the needle reverses upward from its lowest position, it creates a loop of top thread. To create a stitch, a mechanism under the needle plate grabs the loop of top thread and secures it to a bottom thread supplied by a bobbin. The mechanism that grabs the top thread generally consists of a shuttle and bobbin assembly. The bobbin, a spool of bottom thread, sits within the shuttle. The shuttle is rotated by a motor in the sewing machine. The motor rotates the shuttle in synchronization with the upward and downward movement of the needle. The shuttle comprises a shuttle hook that has a hook tip. The hook tip loops the top thread around the bottom thread and creates a lock stitch. The shuttle rotates in time with the needle movement such that the hook tip grabs each loop of top thread as it is created by the upward movement of the needle. The shuttle rotation must be timed such that the hook tip is in the proper position relative to the movement of the needle, or the top thread and bottom thread may not form a proper stitch.

The timing of the system is generally referred to as the timing of the sewing machine. In sewing machines that have a lateral needle swinging mechanism that swings the needle to a left position and a right position, the timing of the machine may not be ideal when the needle is in each of its possible positions. When the machine is "out of time," that is, when the machine timing is not optimal, the hook tip may not be in an optimal position relative to the needle eye. This may occur when the needle is in different lateral positions. This can lead to poor quality stitches, skipped stitches, and broken threads. Generally, the lowermost part of the hook tip should be positioned just above the eye of the needle as the hook tip passes beyond the ascending needle. In sewing machines that have a lateral needle swing mechanism, the hook tip may only be in the optimal position relative to the needle eye when the needle is at one of its many possible lateral positions. Other factors relating to a current sewing situation of the sewing machine may also cause a the machine to become out of time.

Figure 1A:
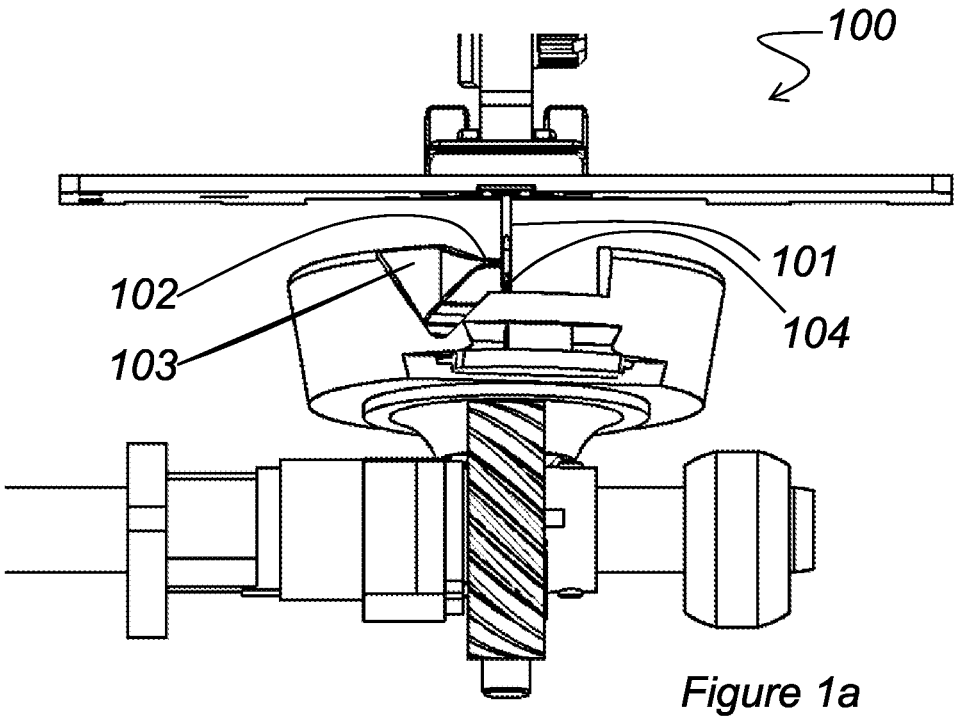
FIG. 1*a* is a rear view of a prior art sewing assembly, showing the needle in a middle position.
Figure 1B:
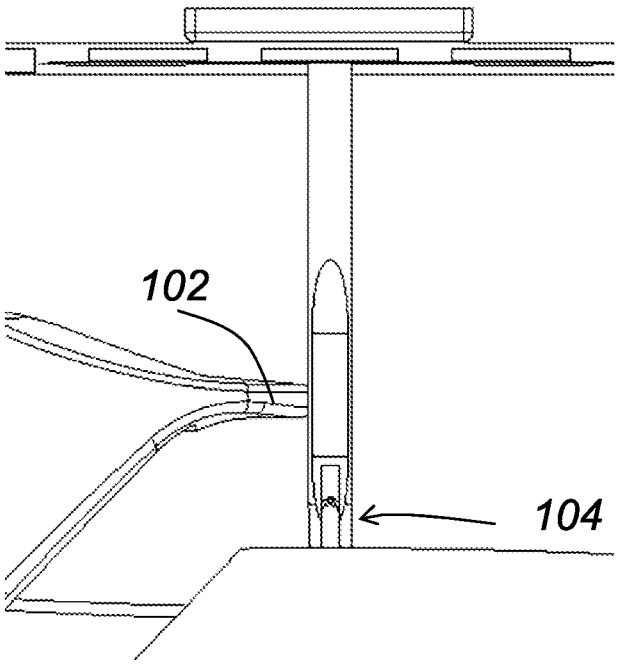
FIG. 1*b* is an enlarged view of a portion of the prior art sewing assembly of FIG. 1*a;*
Figure 1C:
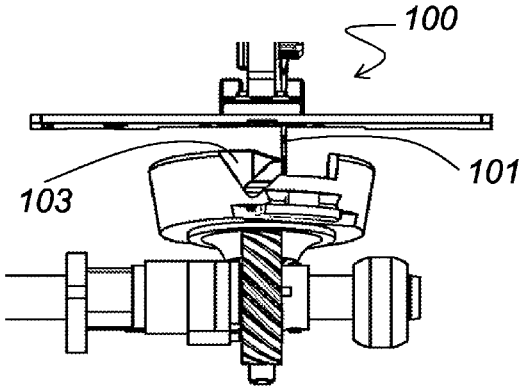
FIG. 1*c* is a rear view of the prior art sewing assembly shown in FIG. 1*a*, showing the needle in a leftmost position.
Figure 1D:
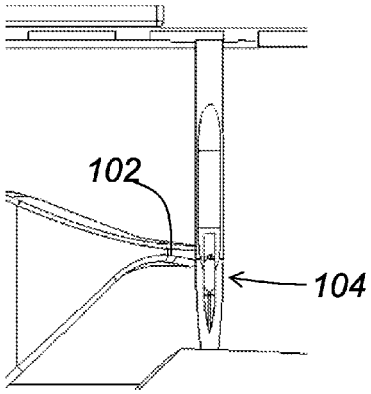
FIG. 1*d* is an enlarged view of a portion of the prior art sewing assembly of FIG. 1*c;*
Figure 1E:
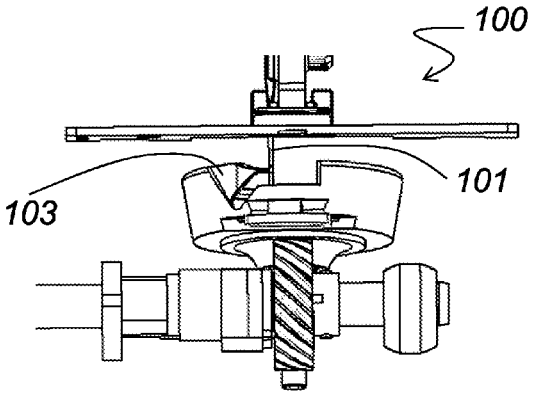
FIG. 1*e* is a rear view of the prior art sewing assembly shown in FIG. 1*a*, showing the needle in a rightmost position.
Figure 1F:
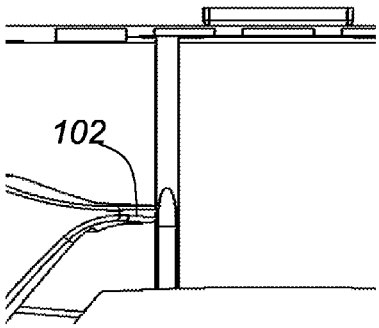
FIG. 1*f* is an enlarged view of a portion of the prior art sewing assembly of FIG. 1*e;*

FIGS. 1*a*-1*f* depict a prior art sewing assembly 100. In the sewing assembly 100, the needle 101 is in a middle lateral position. In FIG. 1*c* and FIG. 1*d*, the needle 101 is in a leftmost lateral position. In FIG. 1*e* and FIG. 1*f*, the needle is in a rightmost lateral position. In all of FIGS. 1*a*-1*f*, the sewing assembly is depicted at a moment when which a hook tip 102 of a shuttle hook 103 is about to grab a loop of top thread (not shown) as the loop of thread is created by the upward movement of the needle 101. As shown in FIGS. 1*a*-1*f*, depending on the lateral needle position, the hook tip 102 will be in different vertical positions relative to an eye 104 of the needle 101 at the moment when the hook tip 102 grabs the loop of thread.

In the prior art sewing assembly, if the timing is such that the hook tip 102 is in a proper position relative to the eye 104 when the needle 101 is in a leftmost position, the hook tip 102 of the prior art sewing assembly might become too low or too high relative to the eye 104 when the needle 101 is in any other lateral position. The variable timing systems of the prior art are thus not optimal, and the hook tip is not accurately positioned for all lateral needle positions. This can lead to poor quality stitches, skipped stitches, and broken threads.

Aspects and embodiments of the present disclosure provide improved variable timing systems of sewing machines, such that poor quality stitches, skipped stitches and broken threads that result from bad timing may be avoided.

The variable timing systems disclosed may ensure that the hook tip is in the proper position relative to the needle eye regardless of the lateral position of the needle and may also adjust to sewing conditions that may otherwise cause the machine to become out of time. In accordance with aspects and embodiments, an improved variable timing system comprises a shuttle hook having a thread seizing hook tip. The variable timing system further comprises a first helical gear mounted on the shuttle hook, and a lower shaft, configured to rotate the shuttle hook in synchronization with vertical movement of a needle bar of the sewing machine. The variable timing system further comprises a second helical gear mounted on the lower shaft and capable of mesh engagement with the first helical gear. At least one of the first helical gear and the second helical gear is selectively moveable in the axial direction.

The variable timing system may further comprise a control device configured to process data representative of a current sewing situation of the sewing machine, and the device may selectively generate a control signal in response to the processed data. The variable timing system may further comprise a drive force mechanism configured to receive the control signal and to transmit axial movement to the axially moveable helical gear. The drive force mechanism may axially move the axially moveable helical gear to one of a plurality of selectable positions provided in a range extending from a first end position to a second end position to ensure the hook tip is in the proper position.

According to a second aspect, a method for selectively adjusting a timing of a variable timing system of a sewing machine is disclosed. The variable timing system comprises a shuttle hook having a thread seizing hook tip, and a first helical gear mounted on the shuttle hook. The variable timing system further comprises a lower shaft configured to rotate the shuttle hook in synchronization with vertical movement of a needle bar of the sewing machine, and a second helical gear, mounted on the lower shaft and capable of mesh engagement with the first helical gear. At least one of the first helical gear and the second helical gear is selectively moveable in the axial direction. The method comprises processing, by means of a control device, data representative of a current sewing situation of the sewing machine. The method further comprises selectively generating a control signal in response to the processed data and, in response to the control signal, transmitting axial movement to the axially moveable helical gear to move the axially moveable helical gear to one of a plurality of selectable positions provided in a range extending from a first end position to a second end position to ensure the hook tip is in the proper position.

In accordance with embodiments, the timing of the sewing machine may advantageously be dynamically adjusted in response to a control signal. The axially moveable helical gear is moveable to a plurality of positions, thus the position of the hook tip, and therefore the machine timing, is variable. The timing of the sewing machine may thus be advantageously adjusted such that the hook tip grabs the top thread when the hook tip is in an optimal position relative to the vertical position of the needle. The control signal facilitates adjustment of timing of the sewing machine in response to a variety of data representative of a current sewing situation, including adjustment based on the lateral position of the needle. The control signal is provided in response to data representing a current sewing situation of the sewing machine, including factors such as needle position, fabric, needle type, and stitch type. Thus, the timing may be adjusted in response to a plurality of factors that may otherwise lead to poor timing.

Figure 2:
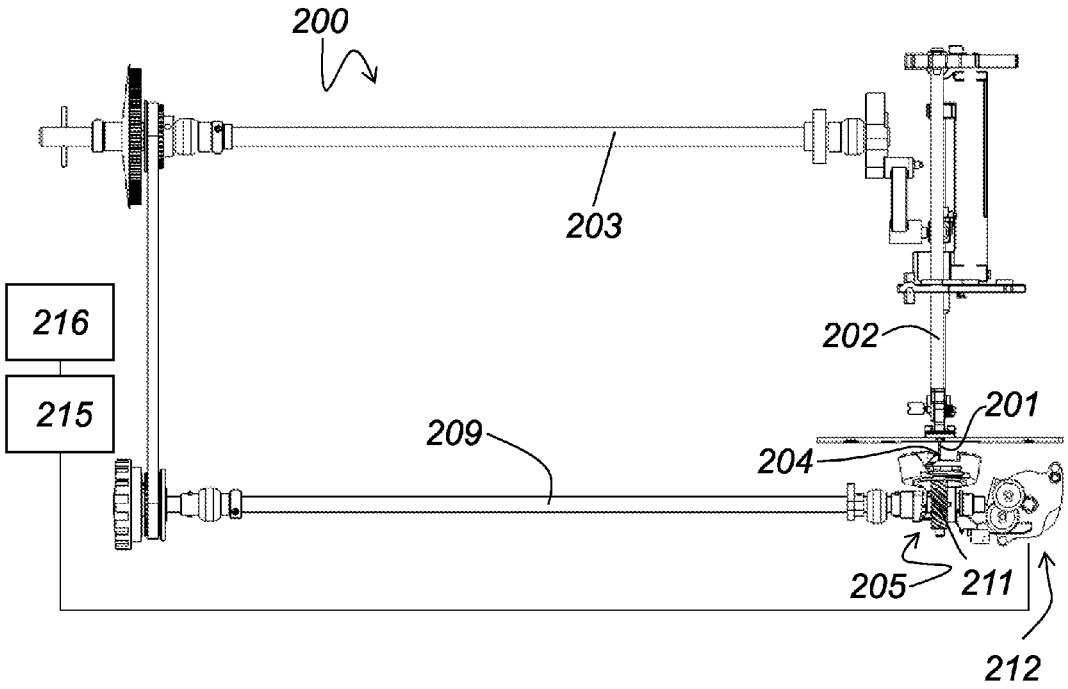
FIG. 2 presents a variable timing system in accordance with aspects and embodiments.

In accordance with embodiments and in reference to FIG. 2, a variable timing system 200 is provided. The variable timing system 200 may be part of a sewing machine in which a needle 201 is connected to a needle bar 202. A vertical needle bar movement mechanism is arranged to drive the needle bar 202 vertically, so as to move the needle 201 upwards and downwards. The needle bar 202 is operably connected to an upper shaft 203 of the sewing machine.

The sewing machine may also comprise a needle swinging mechanism arranged to move the needle bar 202 and the needle 201 in a lateral direction. The needle 201 may thus be moveable within a range extending from a leftmost position to a rightmost position. Needle 201 has an eye 204 in which the top thread is held (thread not shown).

Figure 3:
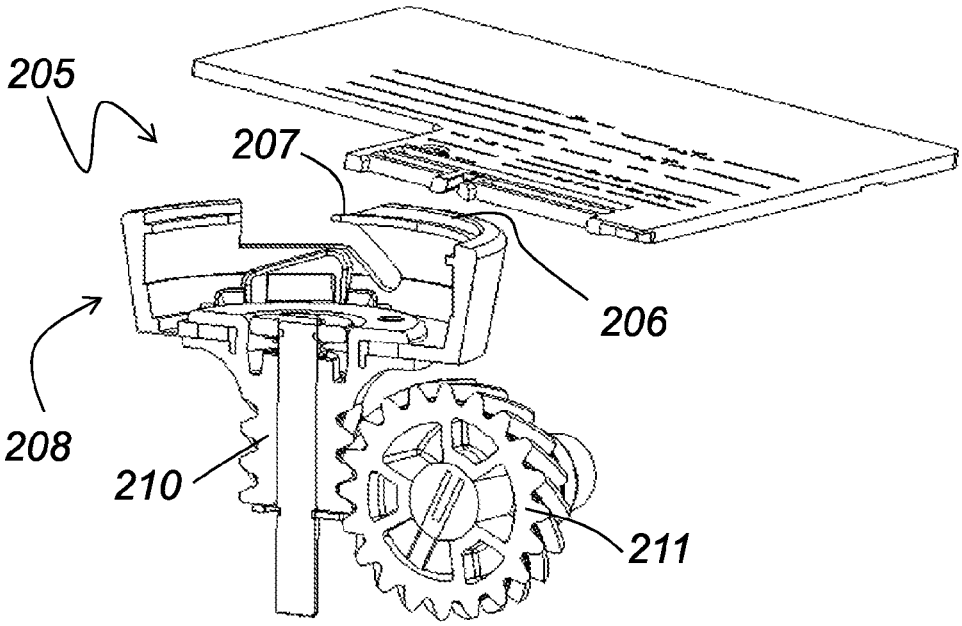
FIG. 3 presents a hook transmission mechanism in accordance with aspects and embodiments.

The variable timing system 200 further comprises a hook transmission mechanism 205. Referring also to FIG. 3, the hook transmission mechanism 205 comprises a shuttle 208 having a shuttle hook 206 having hook tip 207. The hook tip 207 is arranged to grab a portion of the top thread extending through the needle. The shuttle hook 206 of shuttle 208 is arranged to receive a bobbin of bottom thread. The shuttle 208, and thus the shuttle hook 206, may be configured to rotate in time with the needle movement such that the hook tip 207 grabs each loop of top thread as it is created by the upward movement of the needle 201. A lower shaft 209, shown in FIG. 2, is configured to rotate the shuttle hook 206 in synchronization with the vertical movement of the needle bar 202.

Referring again to both FIG. 2 and FIG. 3, the hook transmission mechanism 205 comprises a first helical gear 210 which is connected to the shuttle hook 206. A second helical gear 211 is mounted on the lower shaft 209. The second helical gear 211 is capable of communication with the first helical gear 210 and may, for example, by capable of mesh engagement with the first helical gear 210.

The second helical gear 211 is selectively moveable in the axial direction, meaning that the second helical gear is moveable in a left-right direction of the sewing machine. The second helical gear is selectively moveable in a range extending from a first end position to a second end position. The first end position may be a leftmost position and the second end position may be a rightmost position. The range may comprise a plurality of selectable positions, such that the second helical gear is stepwise moveable between the first end positions and the second end position. The selectable positions may comprise, for example, more than just the two end positions. The second helical gear may also be continuously moveable to any position within the range of the first end position and the second end position. By selectively moving the second helical gear axially, the position of the hook tip can be adjusted such that the timing will be optimal regardless of the current sewing situation. This ensures that the hook tip 207 will always be in the proper position relative to the needle eye 204, and hook tip 207 will grab the top thread at the moment when the needle is in an optimal vertical position.

Figure 4:
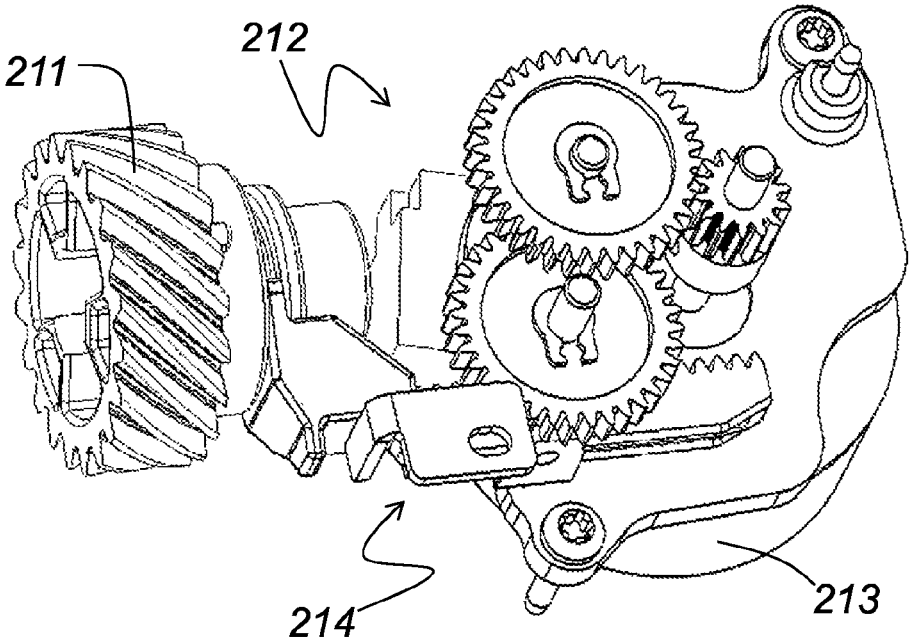
FIG. 4 presents a drive force mechanism in accordance with aspects and embodiments.

In accordance with aspects and embodiments, a drive force mechanism may be configured to move the second helical gear 211 axially. For example and referring to FIG. 4, a drive force mechanism 212 may comprise a stepping motor 213. The stepping motor 213 may be operable in response to a control signal. The drive force mechanism 212 may further comprise a transmission 214 configured to transmit rotational movement generated by the stepping motor 213 to axial movement of the second helical gear 211. The drive force mechanism 212 can thus move the second helical gear 211 in an axial direction.

In accordance with aspects and embodiments, the variable timing systems of the present disclosure may comprise a control device. A control device may, for example, be a processor or a processing unit of the sewing machine. The control device may further facilitate adjustment of machine timing. For example and referring again to FIG. 2, a variable timing system according to embodiments herein may comprise a control device 215 configured to process data representative of a current sewing situation of the sewing machine. The data representative of a current sewing situation of the sewing machine may comprise data representative of a current horizontal needle position, fabric type, or other factors relative to the sewing process being performed. Control device 215 is further configured to selectively generate a control signal in response to the processed data. The control signal is then used to control the operation of the stepping motor 213. By controlling the operation of the stepping motor 213, the transmission 214 may transmit axial movement to the second helical gear 211.

Figure 5A:
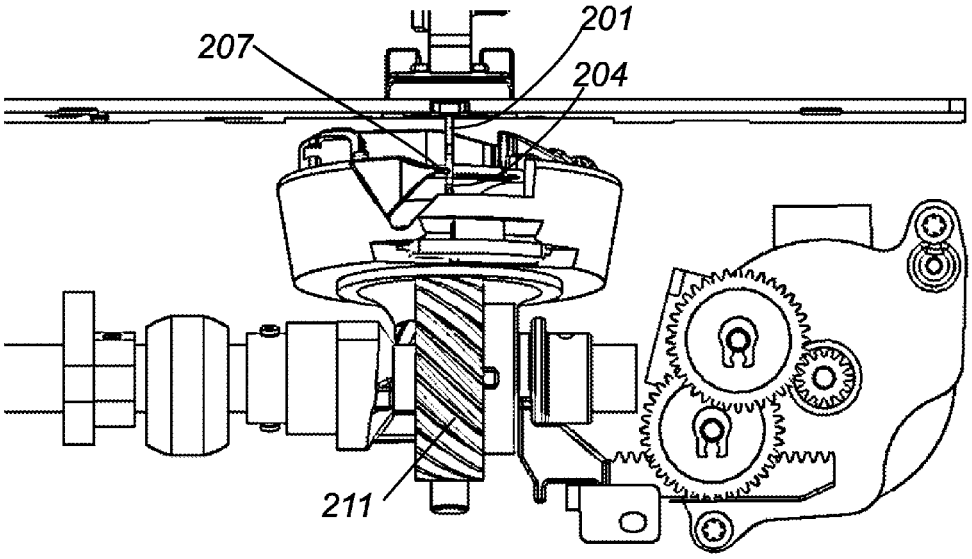
FIG. 5*a* is a rear view of a sewing assembly in accordance with aspects and embodiments herein, showing the needle in a middle position.
Figure 5B:
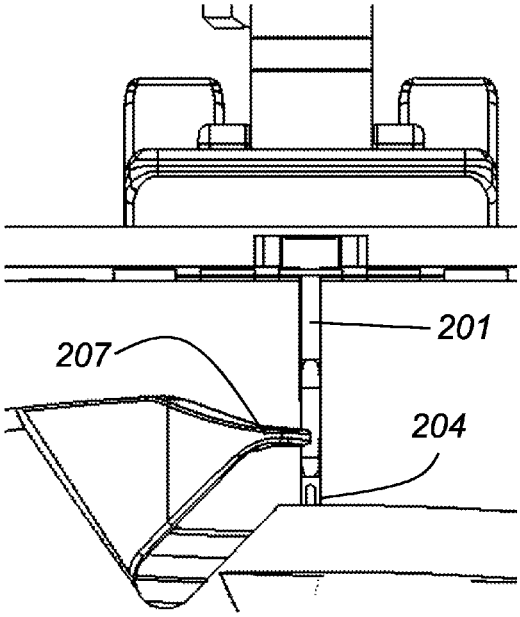
FIG. 5*b* is an enlarged view of a portion of the sewing assembly of FIG. 5*a;*
Figure 5C:
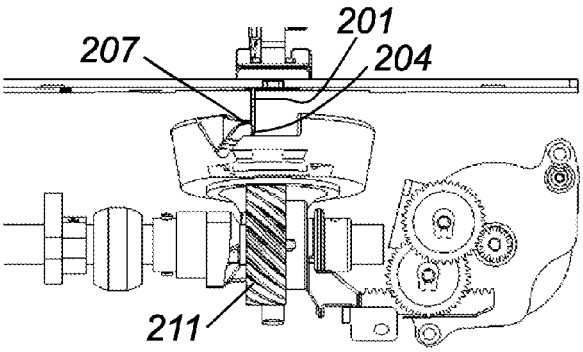
FIG. 5*c* is a rear view of the sewing assembly shown in FIG. 5*a*, showing the needle in a rightmost position.
Figure 5D:
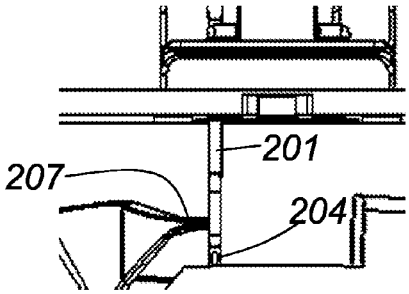
FIG. 5*d* is an enlarged view of a portion of the sewing assembly of FIG. 5*c*.
Figure 5E:
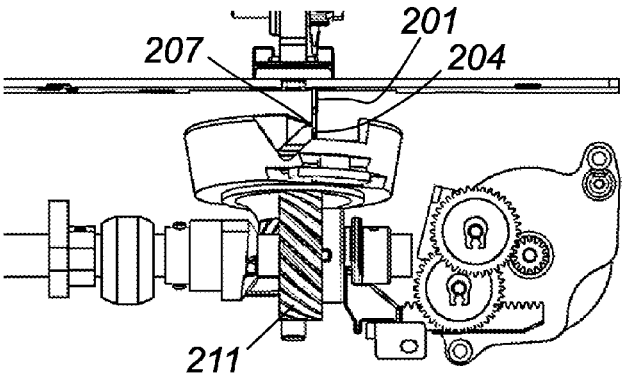
FIG. 5*e* is a rear view of the sewing assembly shown in FIG. 5*a*, showing the needle in a leftmost position.
Figure 5F:
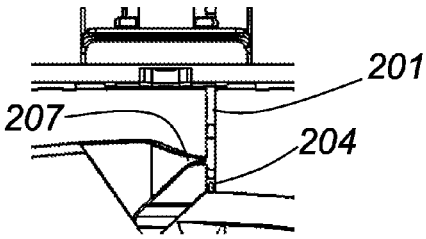
FIG. 5*f* is an enlarged view of a portion of the sewing assembly of FIG. 5*e;*

The data representative of a current sewing situation may comprise data representative of a horizontal needle position. FIGS. 5*a* and 5*b* depict how an optimal axial position of the second helical gear 211 may be selected when the needle 201 is in a middle position. FIGS. 5*c* and 5*d* depict how an optimal axial position of the second helical gear 211 may be selected when the needle 201 is in a rightmost position and FIGS. 5*e* and 5*f* depict how an optimal axial position of the second helical gear 211 may be selected when the needle 201 is in a leftmost position. The position of hook tip 207 is optimal relative to the needle eye 204 in each of the cases depicted in FIGS. 5*a*-5*f*, and the timing is thus optimal regardless of the lateral position of the needle 201. As shown in the figures, the second helical gear may be moved to a plurality of positions within a predefined range, and is thus not limited to a first end position and second end position, but rather can be positioned anywhere between the endmost positions. The position of hook tip 207 may be optimally adjusted relative to the needle eye 204 for horizontal needle positions in addition to the middle, rightmost, and leftmost needle positions.

The data representative of a current sewing situation of the sewing machine may also comprise stitch data representative of characteristics of a currently used stitch type. Different stitches may cause the needle to move in different ways. In accordance with aspects and embodiments, the variable timing systems disclosed herein may be used to adjust the timing depending on the type of stitch being executed by the sewing machine, such that the hook tip will grab the top thread when the needle is in an optimal position, regardless of stitch type.

The data representative of a current sewing situation of the sewing machine may also comprise sewing technique data. Sewing techniques include regular stitching, quilting, embroidering, and other sewing techniques. The variable timing system may be used to adjust the timing to accommodate different sewing techniques.

The data representative of a current sewing situation of the sewing machine may comprise data identifying a current sewing direction. For example, the timing may be different for backwards and forwards sewing. In accordance with aspects and embodiments, the timing can be adjusted to properly account for sewing direction.

The data representative of a current sewing situation of the sewing machine may also comprise fabric data, such as data representative of a category of fabric being sewn and/or data representative of a thickness of the fabric. The type and thickness of the fabric may cause different machine behavior. In accordance with aspects and embodiments, the timing can be adjusted to properly account for variations that may result from the sewing of different fabrics.

The data representative of a current sewing situation of the sewing machine may comprise needle related data, such as data representative of a needle category currently being used. Different needles may be used to sew different fabrics and different stitches, and thus the timing can be adjusted to properly account for different needle types.

The data representative of a current sewing situation of the sewing machine may comprise thread related data, such as data representative of a thread type currently being used. The timing may be different when different threads are used. For example, when elastic thread is used the timing may differ from the timing appropriate for a non-elastic thread. The timing can thus be adjusted to properly account for different thread types.

In accordance with embodiments and referring to FIG. 2, the variable timing system may further comprise a data receiving device 216. The data receiving device 216 may be configured to receive externally generated data. The data receiving device 216 may be further configured to transmit data representative of a current sewing situation of the sewing machine to the control device 215 in response to the received externally generated data.

In accordance with embodiments, the data receiving device may comprise a user interface. The user interface may be a graphical user interface. The externally generated data may be data that a user of the sewing machine provides to the control device by interacting with the graphical user interface.

In accordance with embodiments, the data receiving device may comprise a sensor arrangement. A sensor arrangement may, for example, be provided to monitor a thickness of the fabric being sewn.

In accordance with embodiments, the data receiving device may comprise an image capturing unit. The image capturing unit may, for example, comprise a camera, mounted on the sewing machine. The image capturing unit may be configured to provide image based information regarding the needle, the fabric, or other factors, to the control device 215.

In accordance with embodiments and as shown in FIGS. 2-5, the second helical gear 211 is slidably mounted on the lower shaft 209. The drive force mechanism 212 moves the second helical gear 211 relative to the lower shaft 209.

Figure 6A:
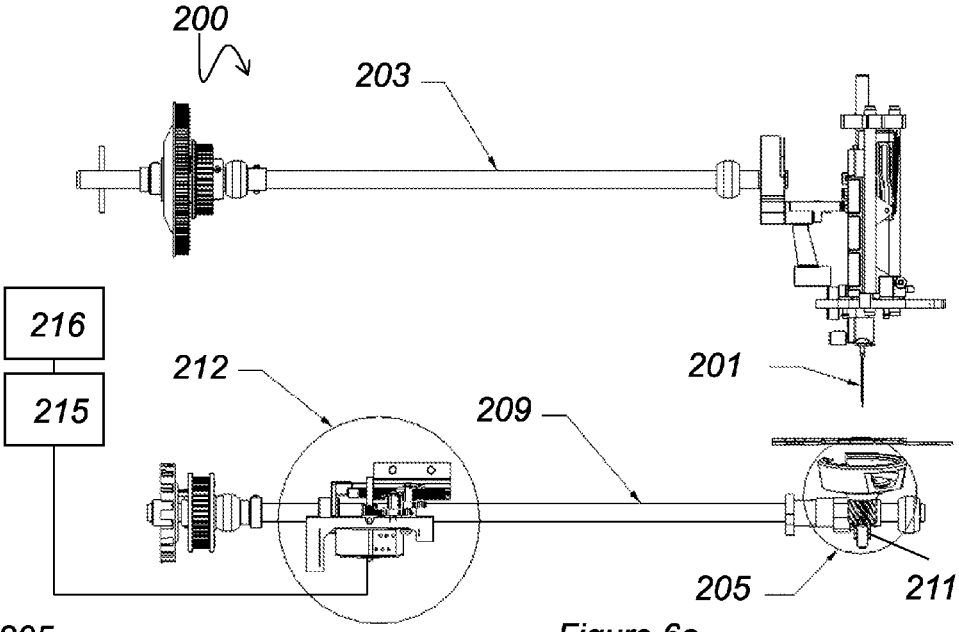
FIG. 6*a* presents a variable timing system in accordance with aspects and embodiments.
Figure 6B:
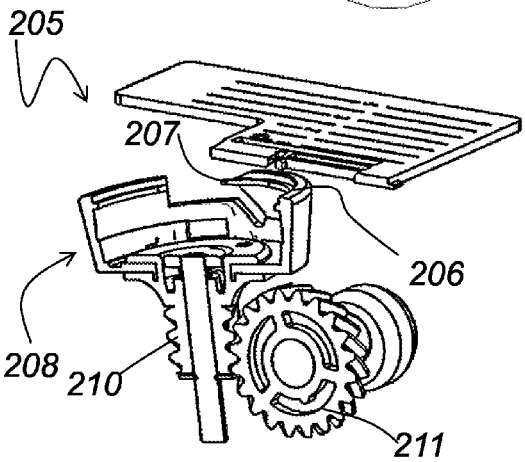
FIG. 6*b* presents a hook transmission mechanism in accordance with aspects and embodiments.
Figure 6C:
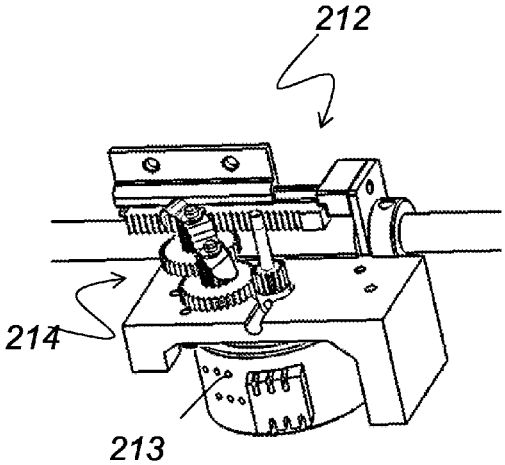
FIG. 6*c* presents a drive force mechanism in accordance with aspects and embodiments.

FIG. 6*a*, FIG. 6*b*, and FIG. 6*c* depict an additional embodiment of a variable timing system. In accordance with aspects and embodiments, the second helical gear 211 is axially moveable, but fixedly connected, to the lower shaft. The drive force mechanism 212 may then be configured to transmit axial movement to the second helical gear 211 by means of transmitting axial movement to the lower shaft 209. The second helical gear is selectively moveable in a range extending from a first end position to a second end position. The first end position may be a leftmost position and the second end position may be a rightmost position. The range may comprise a plurality of selectable positions, such that the second helical gear is stepwise moveable between this plurality of selectable positions. The number of selectable positions may be more than two, and may, for example comprise positions between the first end position and second end position. The second helical gear may also be continuously moveable to any position within the range. By means of selectively moving the lower shaft axially, and thereby also moving the second helical gear axially, the position of the hook tip can be adjusted such that the timing will be optimal and hook tip 207 will always grab the top threat at a moment when the needle 201 is in an optimal vertical position.

Figure 7:
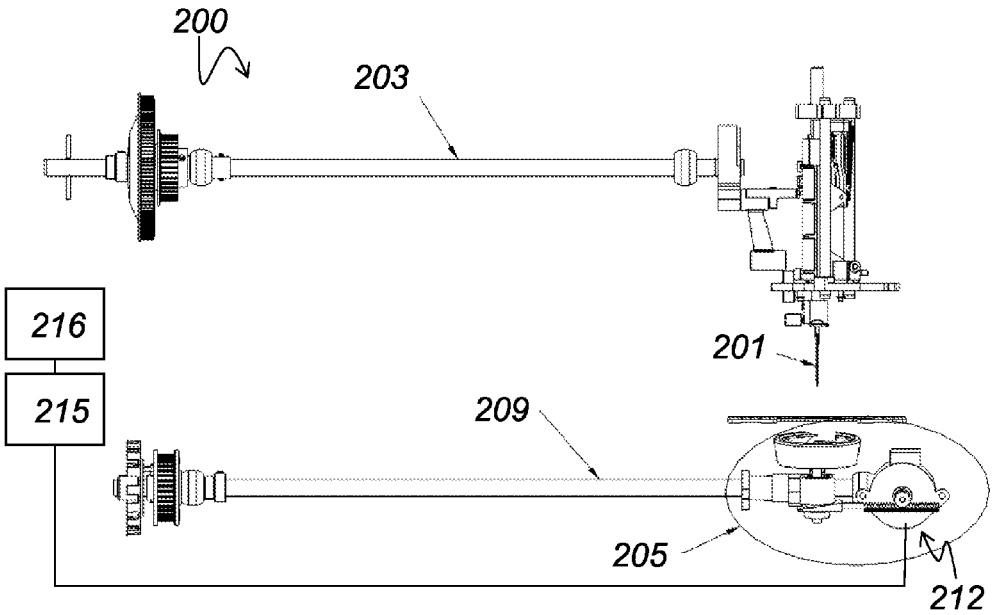
FIG. 7 presents a variable timing system in accordance with aspects and embodiments.
Figure 8:
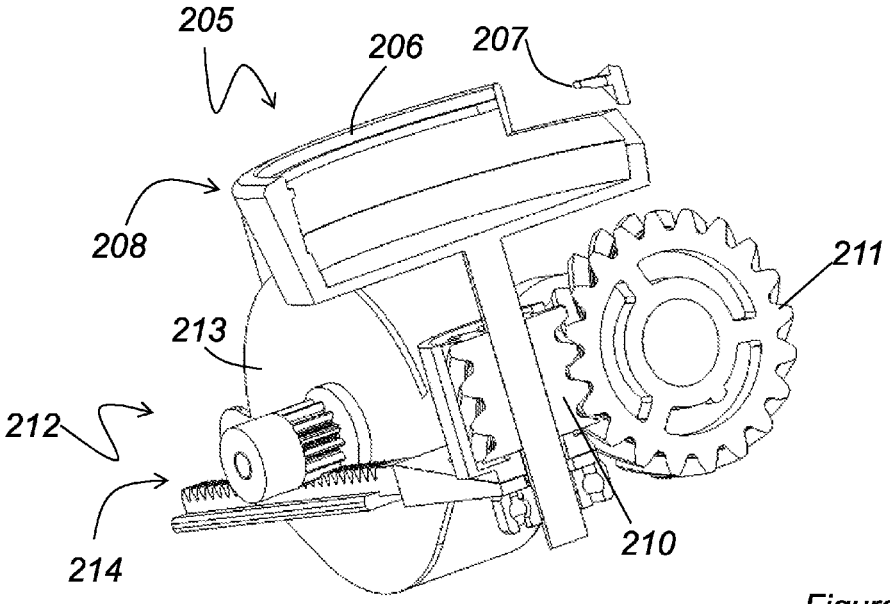
FIG. 8 presents a hook transmission mechanism and drive force mechanism in accordance with aspects and embodiments.

FIG. 7 and FIG. 8 depict another embodiment of a variable timing system in accordance with the present disclosure. In this embodiment, the first helical gear 210 is axially moveable. The drive force mechanism 212 selectively transmits axial movement to the first helical gear 210, so as to move it vertically. By vertically adjusting the first helical gear 210, it is possible to adjust the timing such that the position of hook tip 207 is always optimal relative to the eye 204 of the needle 201. The first helical gear 210 is selectively moveable in a range extending from a first end position to a second end position. The first end position may be a topmost position and the second end position may be a lowermost position. The range of movement of the first helical gear 210 may comprise a plurality of selectable positions, such that the first helical gear 210 is stepwise moveable between a plurality of selectable positions between the topmost position the lowermost position. The first helical gear 210 may also be continuously moveable to any position between the topmost position the lowermost position. By means of selectively moving the first helical gear 210 axially, the position of the hook tip 207 will be adjusted such that the timing will be optimal regardless of the current sewing situation. Thus, hook tip 207 will always grab the top thread at a moment when the needle 201 is in an optimal vertical position.

Figure 9:
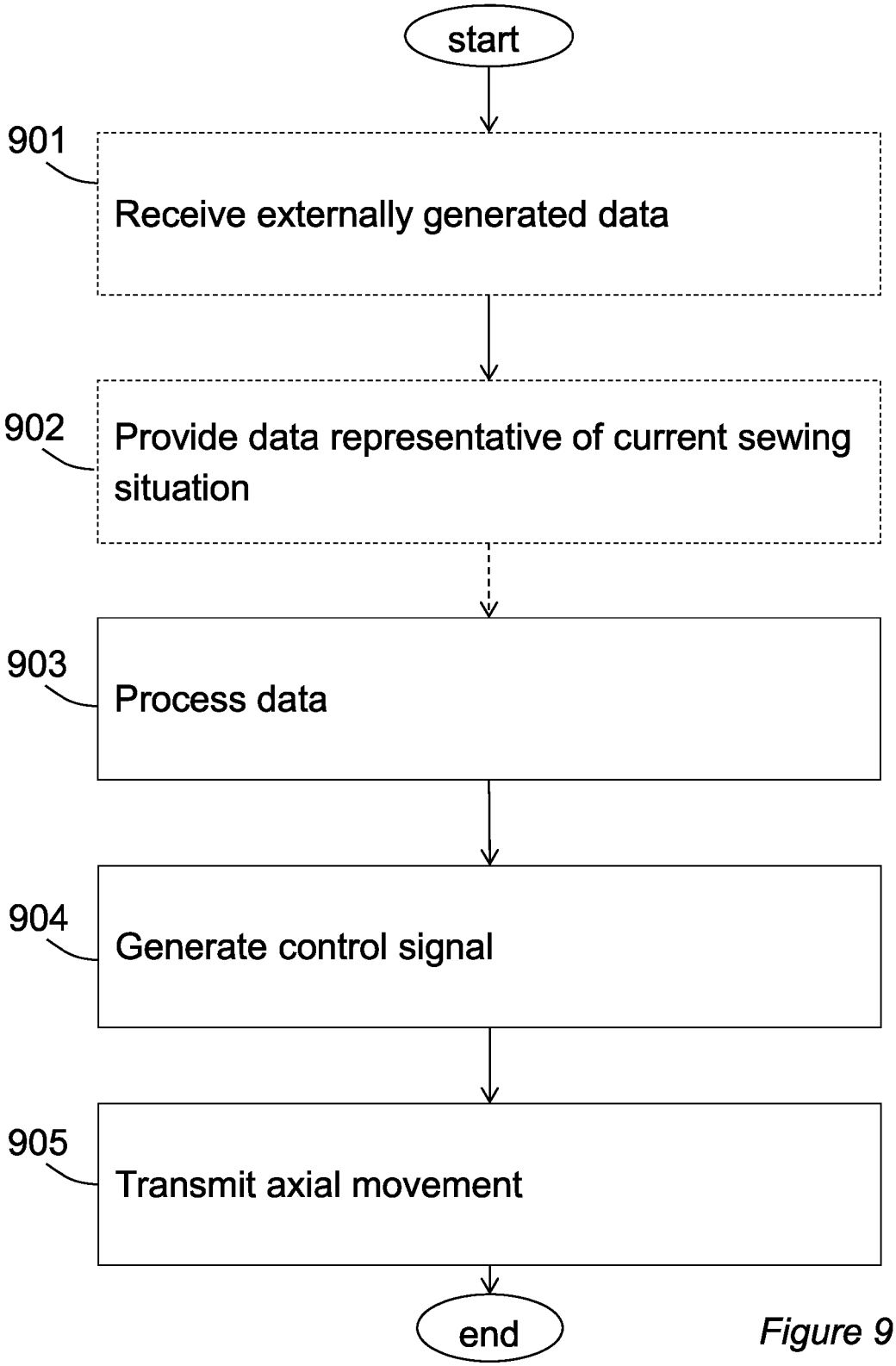
FIG. 9 is a flow chart illustrating embodiments of a method in accordance with aspects and embodiments.

In accordance with aspects and embodiments, the variable timing system of a sewing machine may be selectively adjusted. FIG. 9 is a flowchart of steps that demonstrate how the timing may be adjusted. The method comprises a series of steps that may be taken in any suitable order. Dashed lines indicate that the corresponding step is not mandatory.

In accordance with some embodiments, the variable timing system may comprise a data receiving device 216 that receives externally generated data. The externally generated data may, for example, be received from at least one of a user interface, a sensor arrangement and an image capturing unit. In step 901, externally generated data is received by the machine.

In accordance with some embodiments, the variable timing system comprises a data receiving device 216 that provides data representative of a current sewing situation in response to externally generated data. In step 902, externally generated data is provided as data representative of a current sewing situation.

In accordance with aspects and embodiments, a variable timing system may comprise a control device 215 used to process data representative of a current sewing situation. In step 903, this data is processed. In step 904, the control device is used to generate a control signal in response to the processed data.

In step 905, the control signal may be provided to the drive force mechanism 212 of the variable timing system. The drive force mechanism may transmit axial movement to at least one of the axially moveable helical gears 210 and 211 in response to the control signal to axially move the at least one of the axially moveable helical gears to one of a plurality of selectable positions. By selecting an appropriate position of at least one of the axially moveable helical gears, an optimal position of the hook tip 207 relative to the needle eye 204 may be dynamically selected in response to a current sewing situation of the sewing machine.

It is to be appreciated that embodiments of the systems discussed herein are not limited in application to the details of construction and the arrangement of components as set forth in the above description or illustrated in the accompanying drawings. The systems are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiment.

Also, the phraseology and terminology used herein is for the purpose of description and should not be regarded as limiting. Any references to embodiments or elements or acts of the apparatus and methods herein referred to in the singular may also embrace embodiments including a plurality of these elements, and any references in plural to any embodiment or element or act herein may also embrace embodiments including only a single element. The use herein of "including," "comprising," "having," "containing," "involving," and variations thereof is meant to encompass the items listed thereafter and equivalents thereof as well as additional items. When using including," "comprising," "having," "containing," "involving," and variations thereof it shall be interpreted as non-limiting, i.e. meaning "consist at least of".

Any references to positional or spatial orientation are intended for convenience of description, not to limit the present apparatus and methods or their components.

Having described above several aspects of at least one embodiment, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only.

What is claimed:

1. A variable timing system of a sewing machine, the variable timing system comprising:

a shuttle hook having a hook tip;

a first helical gear mounted on the shuttle hook;

a lower shaft configured to rotate the shuttle hook in synchronization with vertical movement of a needle bar of the sewing machine, wherein the needle bar moves in a range between a top position and a bottom position;

a second helical gear mounted on the lower shaft and capable of mesh engagement with the first helical gear, at least one of the first helical gear and the second helical gear being an axially moveable helical gear which is selectively moveable in its axial direction;

a control device configured to process data representative of a current sewing situation of the sewing machine and to selectively generate a control signal in response to processing the data; and a drive force mechanism configured to receive the control signal and to transmit axial movement to the axially moveable helical gear in response to the control signal so as to axially move the axially moveable helical gear to one of a plurality of selectable positions provided in a range extending from a first end position to a second end position.

2. The variable timing system according to claim 1, wherein the data representative of a current sewing situation of the sewing machine comprises at least one of:

data representative of a current horizontal needle position;

stitch data representative of characteristics of a currently used stitch type;

sewing technique data, representative of a sewing technique currently being used;

data identifying a current sewing direction;

fabric data, such as data representative of a category of fabric currently used and/or data representative of a thickness of a currently used fabric;

needle related data, such as data representative of a needle category currently being used; and thread related data, such as data representative of a thread type currently being used.

3. The variable timing system according to claim 2, wherein the variable timing system further comprises a data receiving device configured to receive externally generated data and to provide data representative of a current sewing situation of the sewing machine to the control device, in response to the received externally generated data.

4. The variable timing system according to claim 3, wherein the data receiving device comprises at least one of:

a user interface;

a sensor arrangement; and an image capturing unit.

5. The variable timing system according 4, wherein the drive force mechanism comprises a stepping motor operable in response to the control signal and a transmission configured to transmit rotational movement generated by the stepping motor to axial movement of the axially moveable helical gear.

6. The variable timing system according to any one of claim 5, wherein the second helical gear is an axially moveable helical gear which is selectively moveable in the axial direction, and wherein the drive force mechanism is configured to transmit axial movement to the second helical gear.

7. The variable timing system according to claim 6, wherein the second helical gear is slidably mounted on the lower shaft.

8. The variable timing system according to claim 6, wherein the second helical gear is fixedly connected to the lower shaft and wherein the drive force mechanism is configured to transmit axial movement to the second helical gear by means of transmitting axial movement to the lower shaft.

9. The variable timing system according to claim 5, wherein the first helical gear is an axially moveable helical gear which is selectively moveable in the axial direction and wherein the drive force mechanism is configured to transmit axial movement to the first helical gear.

10. A sewing machine comprising a variable timing system according to any one of claims 1-9.

11. A method for selectively adjusting a timing of a variable timing system of a sewing machine, wherein the variable timing system comprises a shuttle hook having hook tip, a first helical gear mounted on the shuttle hook, a lower shaft configured to rotate the shuttle hook in synchronization with vertical movement of a needle bar of the sewing machine, wherein the needle bar moves in a range between a top position and a bottom position, and a second helical gear mounted on the lower shaft and capable of mesh engagement with the first helical gear, at least one of the first helical gear and the second helical gear being an axially moveable helical gear which is selectively moveable in its axial direction, the method comprising:

processing, by means of a control device, data representative of a current sewing situation of the sewing machine;

selectively generating a control signal in response to the processed data; and transmitting axial movement to the axially moveable helical gear in response to the control signal to axially move the axially moveable helical gear to one of a plurality of selectable positions provided in a range extending from a first end position to a second end position.

12. The method according to claim 11, wherein the data representative of a current sewing situation of the sewing machine comprises at least one of:

data representative of a current horizontal needle position;

stitch data representative of characteristics of a currently used stitch type;

sewing technique data, representative of a sewing technique currently being used;

data identifying a current sewing direction;

fabric data, such as data representative of a category of fabric currently used and/or data representative of a thickness of a currently used fabric;

needle related data, such as data representative of a needle category currently being used; and thread related data, such as data representative of a thread type currently being used.

13. The method according to any one of claim 12, wherein the method furthermore comprises receiving externally generated data and providing data representative of a current sewing situation of the sewing machine in response to the received externally generated data.

14. The method according to claim 11, wherein the receiving of externally generated data comprises at least one of:

receiving externally generated data via a user interface;

receiving externally generated data via a sensor arrangement; and receiving externally generated data via an image capturing unit.

15. A variable timing system for a sewing machine comprising:

a rotatable shuttle having a hook tip;

a first helical gear coupled to the rotatable shuttle;

a second helical gear in communication with the first helical gear; and a lower shaft in communication with the second helical gear.

16. The variable timing system of claim 15, further comprising a drive force mechanism in communication with the lower shaft.

17. The variable timing system of claim 16, wherein the drive force mechanism transmits axial movement to the lower shaft.

18. The variable timing system of claim 17, wherein axial movement of the lower shaft facilitates adjustment of a position of the hook tip.

19. A variable timing system for a sewing machine comprising:

a rotatable shuttle having a hook tip;

a first helical gear coupled to the rotatable shuttle;

a second helical gear in communication with the first helical gear; and a drive force mechanism in communication with the second helical gear.

20. The variable timing system of claim 19, wherein the drive force mechanism transmits axial movement to the second helical gear.

21. The variable timing system of claim 20, wherein axial movement of the second helical gear transmits movement to the first helical gear.

22. The variable timing system of claim 21, wherein movement of the first helical gear facilitates adjustment of a position of the hook tip.

23. A variable timing system for a sewing machine comprising:

a rotatable shuttle having a hook tip;

a first helical gear coupled to the rotatable shuttle;

a second helical gear in communication with the first helical gear; and a drive force mechanism in communication with the first helical gear.

24. The variable timing system of claim 23, wherein the drive force mechanism transmits vertical movement to the first helical gear.

25. The variable timing system of claim 24, wherein movement of the first helical gear facilitates adjustment of a position of the hook tip.

26. A sewing machine comprising a variable timing system according to any one of claims 15-25.

* * * * *